US006251194B1

(12) United States Patent
Williams et al.

(10) Patent No.: US 6,251,194 B1
(45) Date of Patent: Jun. 26, 2001

(54) METHOD FOR MOPPING AND SCRUBBING A SURFACE USING AN APPARATUS FOR PESTICIDE ELIMINATION AND SURFACE TRACTION TREATMENT

(75) Inventors: Todd A. Williams, Aliso Viejo; Richard A. Williams, Dana Point, both of CA (US)

(73) Assignee: S. C. Johnson Commercial Markets, Inc., Sturtevant, WI (US)

( * ) Notice: Subject to any disclaimer, the term of this patent is extended or adjusted under 35 U.S.C. 154(b) by 0 days.

(21) Appl. No.: 09/442,963

(22) Filed: Nov. 18, 1999

Related U.S. Application Data

(60) Division of application No. 09/095,947, filed on Jun. 11, 1998, now Pat. No. 6,085,377, which is a continuation-in-part of application No. 08/964,154, filed on Nov. 6, 1997, now Pat. No. 5,964,005.

(51) Int. Cl.[7] ..... A47L 13/255; B08B 7/00

(52) U.S. Cl. ..... 134/6; 134/26; 134/42; 15/114; 15/115; 15/116.1; 15/118

(58) Field of Search ..... 134/6, 42, 26; 15/115, 118, 114, 116.1

(56) References Cited

U.S. PATENT DOCUMENTS

| | | | |
|---|---|---|---|
| D. 358,487 | 5/1995 | Kneesch et al. . | |
| 377,955 | 2/1888 | O'Blenus . | |
| 399,223 | 3/1889 | Varney . | |
| 702,998 | 6/1902 | Randolph . | |
| 729,581 | 6/1903 | Held . | |
| 732,743 | 7/1903 | Held . | |
| 798,532 | 8/1905 | Sanders . | |
| 937,007 | 10/1909 | McLaughlin . | |
| 981,756 | 1/1911 | Glancey . | |
| 1,067,570 | 7/1913 | Ziegler . | |
| 1,171,768 | 2/1916 | Browning . | |
| 1,221,606 | 4/1917 | Sadler . | |
| 1,331,477 | 2/1920 | Albin . | |
| 1,576,777 * | 3/1926 | Moore | 15/229.2 |
| 1,589,253 | 6/1926 | Smiechewicz . | |
| 1,748,202 | 2/1930 | Bloomfield . | |
| 2,133,148 | 10/1938 | Paul . | |
| 2,304,961 | 12/1942 | Schulman | 15/147 |
| 2,518,765 | 8/1950 | Ecker . | |
| 2,641,787 | 6/1953 | Vosbikian et al. . | |
| 2,678,458 | 5/1954 | Vosbikian et al. . | |
| 2,683,886 | 7/1954 | Neumann . | |
| 2,691,788 * | 10/1954 | Thomasson | 15/288 |
| 2,701,888 | 2/1955 | Vosbikian et al. . | |
| 2,988,766 * | 6/1961 | Anderson et al. | 15/229.2 |
| 3,157,901 | 11/1964 | Murphy . | |

(List continued on next page.)

FOREIGN PATENT DOCUMENTS

| | | | |
|---|---|---|---|
| 737140 | 6/1966 | (CA) . | |
| 4330271A1 | 3/1995 | (DE) | A47L/13/12 |
| 196 37 000C1 | 4/1998 | (DE) | A47L/13/14 |
| 0864292A2 | 9/1998 | (EP) | A47L/23/24 |
| 1309326 | 10/1962 | (FR) . | |

OTHER PUBLICATIONS

"Edge Hog—An Advanced Cleaning Tool" by EMSCO Group, Girard, PA No Date.

*Primary Examiner*—Zeinab El-Arini
(74) *Attorney, Agent, or Firm*—S. C. Johnson Commercial Markets, Inc.

(57) ABSTRACT

A method for cleaning or restoring a surface using a mop that is attached to a carrier block. A flowable pesticide or restorative material is applied and removed by passing the mop over and in contact with the material that is applied in closely timed relationship. The method further utilizes different mops attached to the carrier block for each phase, one of which has grommets for attaching the mops to the carrier block.

7 Claims, 16 Drawing Sheets

U.S. PATENT DOCUMENTS

| | | | | |
|---|---|---|---|---|
| 3,167,798 | | 2/1965 | Dryden . | |
| 3,906,580 | | 9/1975 | Smith et al. . | |
| 3,964,121 | | 6/1976 | Kim . | |
| 4,604,767 | | 8/1986 | Burkhart et al. | 15/119 A |
| 4,802,782 | | 2/1989 | Scalf . | |
| 4,928,342 | * | 5/1990 | Friedman et al. | 15/229.2 |
| 5,435,852 | | 7/1995 | Robinson . | |
| 5,522,110 | | 6/1996 | Borofsky . | |
| 5,584,091 | | 12/1996 | Borofsky . | |
| 5,661,866 | * | 9/1997 | Cameron | 15/229.1 |
| 5,782,991 | | 7/1998 | Van der Heyden et al. | 134/37 |
| 5,902,411 | * | 5/1999 | Williams et al. | 134/3 |
| 5,903,948 | * | 5/1999 | Williams et al. | 15/115 |
| 5,913,347 | | 6/1999 | Wilen | 15/115 |

* cited by examiner 31
13
13b
35
90
65

13
13a
35
91
92

111
106
104
110
103
13b'
101
13
102
105
100
96
97

112
140
127
111
117
125
113
126
116
110

METHOD FOR MOPPING AND SCRUBBING A SURFACE USING AN APPARATUS FOR PESTICIDE ELIMINATION AND SURFACE TRACTION TREATMENT

This is a divisional application of application Ser. No. 09/095,947, filed Jun. 11, 1998, now U.S. Pat. No. 6,085,377 which application is a continuation-in-part of U.S. application Ser. No. 08/964,154 filed Nov. 6, 1997, now U.S. Pat. No. 5,964,005.

This invention relates generally to treatment of surfaces, such as cleaning surfaces; and more particularly, to improvements in mops, mop retention, and mounting, apparatus for scrubbing and mopping of surfaces by force application, as via an elongated handle; and surface treatment methods, including substantially simultaneous application to such surfaces of pesticide and traction treatment materials, as for example prior to or subsequent to surface cleaning.

Many surfaces to be cleaned contain interstices, cracks or crevices, in which dirt particles become embedded or otherwise build up. Examples are cracks between tiles forming tiled surfaces, cracks and crevices in marble, clay, concrete, or synthetic material flooring, and surface interstices in many different types of floors. It is extremely difficult to remove such embedded or built up dirt particles using conventional mopping apparatus and/or procedure. It becomes necessary to scrub such surfaces, using a brush or brushes having bristles that can reach and remove the embedded soil or dirt particles.

In the past, it was known to provide for scrubbing and mopping of floor surfaces, using elongated handled equipment; however, such equipment lacked the unusually advantageous improvements in structure, functions and results, as are now enabled and produced by the present invention, and meeting needs for improved and more effective use and operation, as will appear.

SUMMARY OF THE INVENTION

It is a major object of the invention to provide improved apparatus and methods meeting the above needs. Basically, the improved mop aspect of the invention concerns a mop, as is easily and readily applied to a carrier, and is easily and readily removable from the carrier as for replacement. The mop comprises:

a) a laterally extending head band, and mopping strands extending generally longitudinally from the head band, and b) two grommets attached to the head band to define through openings for passing fasteners that attach the mop to the carrier.

As will appear, the head band may typically have lateral length 11, and a medial region, the grommets being spaced apart from the medial region at a spacing $l_2$, and where $l_2$ is substantially less than $l_1$. Further, the grommets are typically, equally spaced from the lateral ends of the head band for balanced attachment of the mop to the carrier, as by fasteners which are spaced at equal distances from the center of the carrier.

Another object is to provide a mop with grommets, as referred to, to be attached to a carrier block, which also carries scrubbing means presented downwardly toward a surface to be scrubbed, the mop, attached via the two grommets to a forward surface of the carrier, whereby the mopping strands extend forwardly longitudinally beyond the scrubbing means, thereby enabling ready mopping and scrubbing simultaneously of a surface to be cleaned.

It is another object of the invention to provide improved apparatus for scrubbing a surface, and comprising, in combination:

a) a supporting carrier, including a block and scrubbing means carried by the carrier, to project toward the surface for scrubbing that surface, b) first means for attaching an elongated handle to the carrier to extend in a first direction from the carrier, c) and structure for attaching a mop to the carrier with mop strands extending in generally parallel relation with that surface and in mopping contact therewith as the scrubbing means simultaneously engages that surface, for simultaneous mopping and scrubbing of that surface, as the handle extends at an angle to the surface to displace the carrier, scrubbing means and mop parallel to the floor surface, d) and including the mop having a head band attached to the carrier at a first side of the carrier, there being at least two grommets attached to the head band to define through openings for passing fasteners that attach the mop to the carrier.

As referred to, the fasteners typically and advantageously pass through the grommet openings and into the carrier block, at locations equally spaced from the center of the block, such spacings together being less than the overall width of the block, to provide advantages, as will appear.

An additional object is to provide a carrier that has first and second parts which are relatively movable longitudinally, the scrubbing means carried by at least one of the parts, the parts relatively adjustably movable longitudinally to clamp the mop head.

Another object is to provide structure associated by the carrier and having teeth presented toward and gripping engaging the head band, at lateral sides of the grommets.

A further object is to provide structure that includes an adjustable clamp for adjustably clamping the mop head, and having a first position in which the mop head is removable from attachment to the carrier, and a second position in which the mop head is attached to the carrier. The clamp typically has a part with adjustable screw thread fastener attachment to the carrier. An additional object includes the provision of scrubbing means on the carrier block, which is either bristles or in the form of a scrubbing pad, these elements located rearwardly of the mopping grommets. The bristles may include rows of bristles, with the bristles of one row having lengths greater than bristles in other rows, one row extending parallel to the mop head.

A yet further object is to provide an improved mop having a head band that extends in a lateral direction, and fastener supports providing openings through the head band, the supports being laterally spaced apart, so that a plane which extends in a longitudinal direction substantially normal to the head band and bisecting the spacing between the fastener supports also substantially bisects the mop.

An additional object is to provide a surface treatment method, which includes:

a) applying a flowable pesticide material to the surface, as for example to corners and crevices of a room, b) and applying a flowable surface restorative or traction material to the surface, as for example a walkway, such applications being location and timewise related, as for example, to contiguous surfaces in a room, and the applications effected during the same work period.

Selected portions or excess portions of the applied materials may be removed by providing and passing at least one mop over and in contact with the flowable material or materials on the surface or surfaces..

These and other objects and advantages of the invention, as well as the details of an illustrative embodiment, will be more fully understood from the following specification and drawings, in which:

DRAWING DESCRIPTION

FIG. 4 is an enlarged section taken on lines 4—4 of FIG. 2;

DETAILED DESCRIPTION

Figure 1:
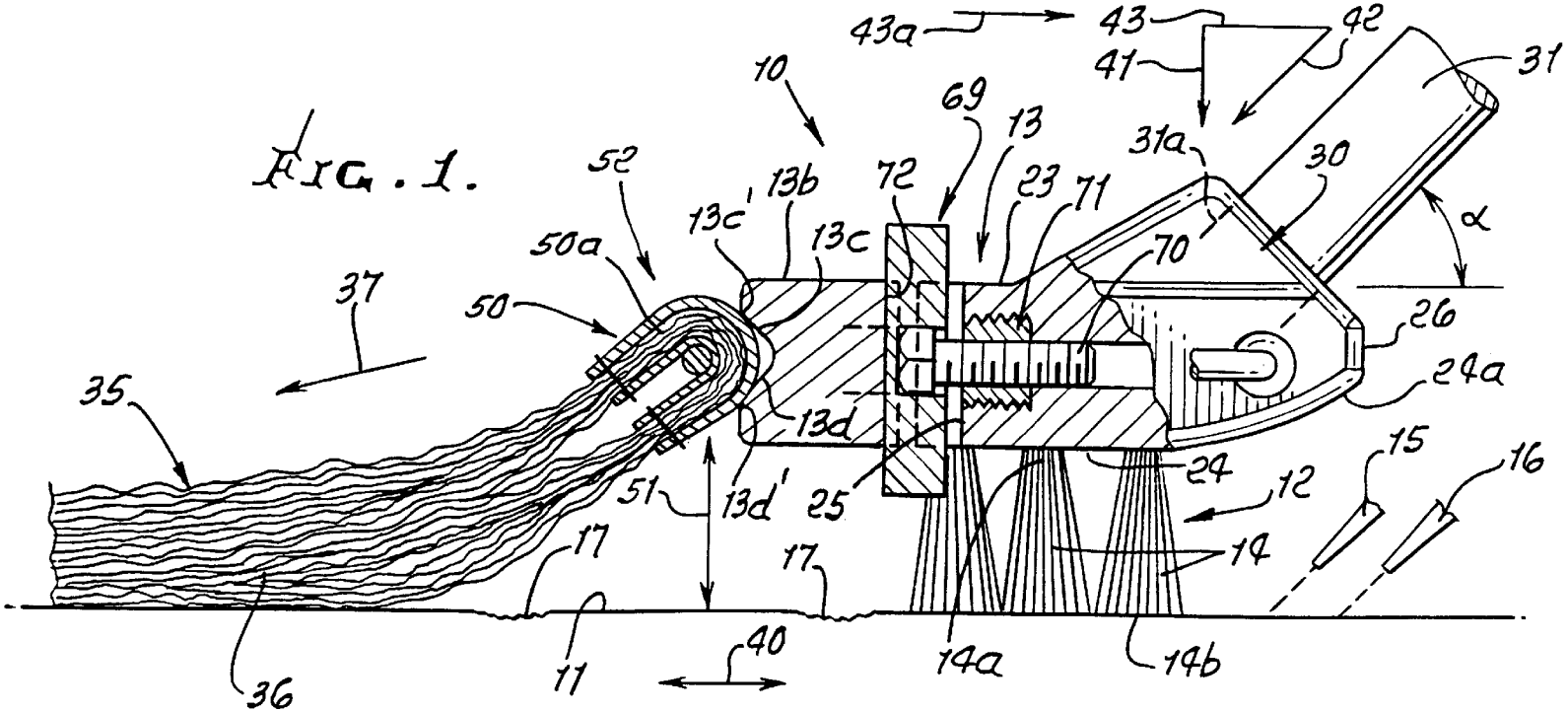
FIG. 1 is a side elevation, in section, of apparatus embodying the invention.

In FIG. 1, one form of the apparatus 10, for scrubbing and mopping a surface 11, such as a floor, is shown in operating position. The basic elements comprise a scrub brush 12 that includes a carrier 13, and bristles 14 having their upper ends 14*a* carried by the carrier at its underside. The bristles project, as for example, downwardly as shown, toward the surface 11 in position for contacting that surface at bristle lower ends 14*b*.

Water and/or chemical cleaner may be applied to that surface, as at 15 and 16, to aid in bristle dislodgment of soils, grit and dirt particles from interstices and cracks in that surface. These are indicated at 17, and may take various forms.

Figure 2:
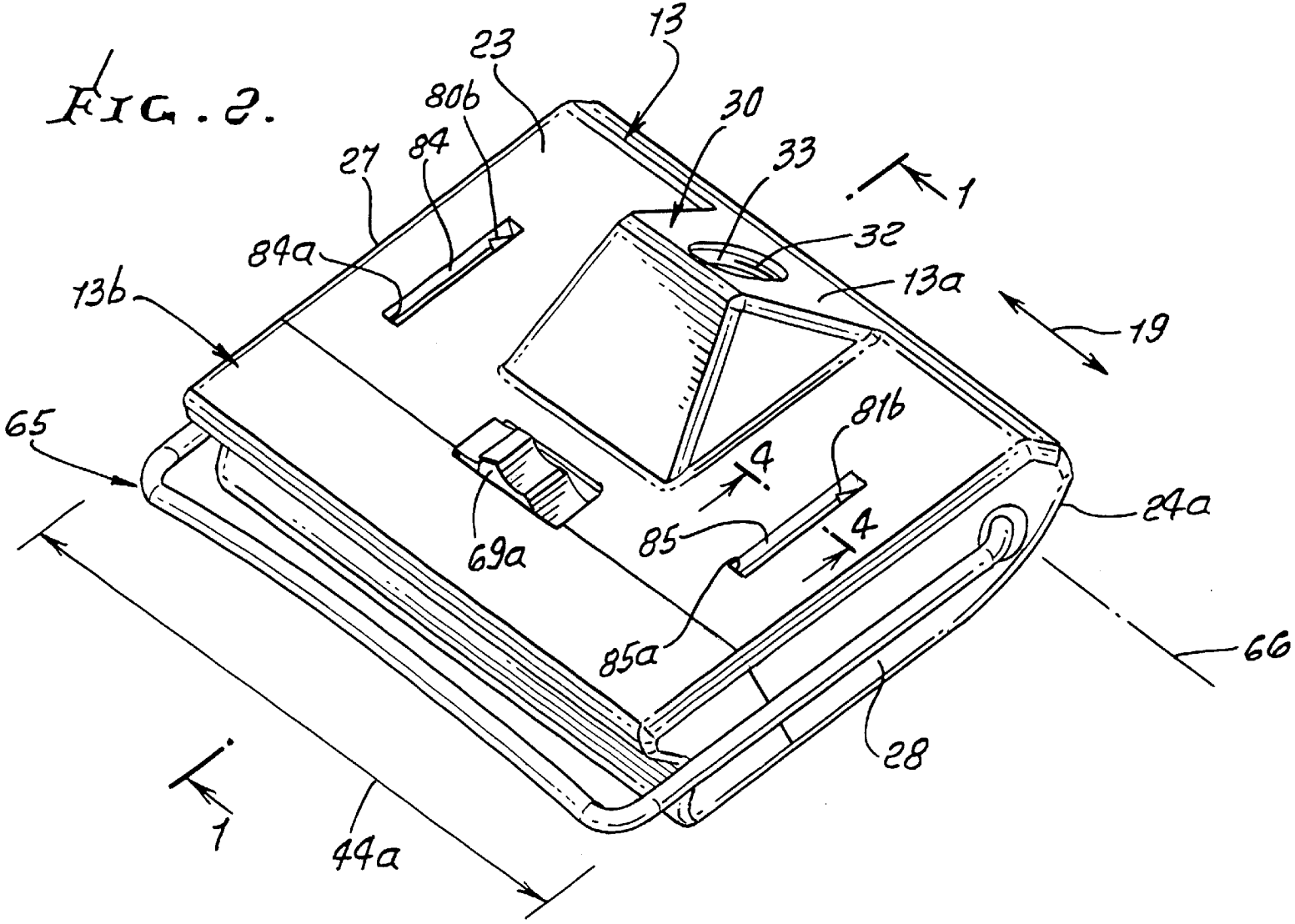
FIG. 2 is a three dimensional view of the FIG. 1 apparatus, without the mop attached.
Figure 3:
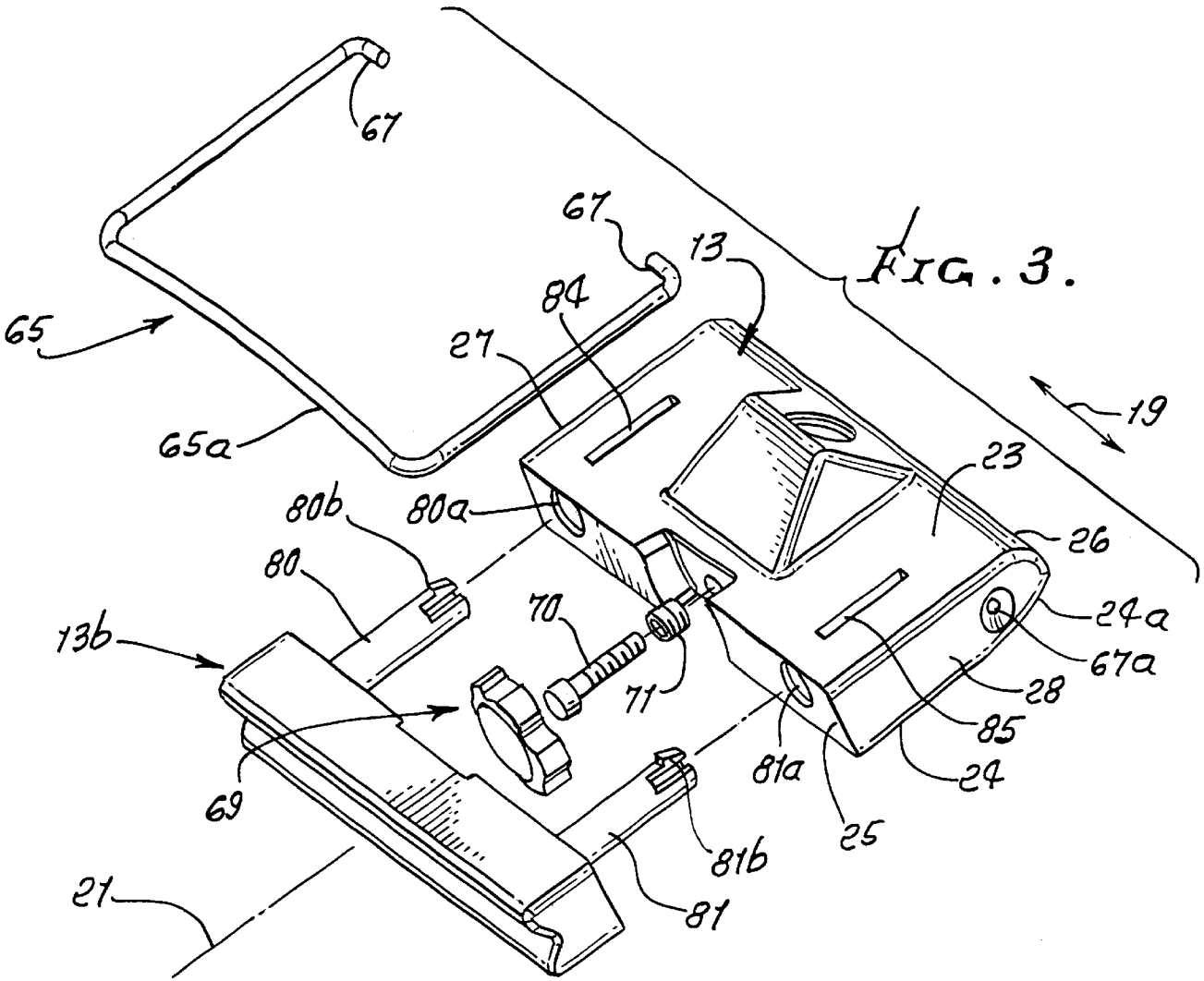
FIG. 3 is an exploded view like that of FIG. 2.

Carrier 13 is typically laterally elongated in directions 19, as seen in FIG. 2, and relative to a longitudinal axis 21, seen in FIG. 3. Carrier 13 may consist of wood, plastic, or other material, and has an upper side 23, a bottom side 24 from which the bristles project, a front side 25, a rear side 26, and opposite ends 27 and 28. Side 25 may be perpendicular, or substantially perpendicular, to axis 21, and to the planes of upper and lower sides 23 and 24. Surface 24 may be beveled as at 24*a*, to facilitate rocking of the carrier, as during use.

First means is provided, as at 30, for attaching an elongated handle 31 to the carrier, to extend in a first direction from the carrier, which may have block shape. Such first means may, for example, include female screw threading at 32 formed in a recess 33 sunk downwardly and forwardly in a protrusion 13*a* at the carrier top side 23, mid-way between opposite ends 27 and 28. The lower end portion 31*a* of the handle may form or carry complementary male threading to rotatably attach to threading 32, whereby the handle is firmly connected to the carrier, to extend upwardly and rearwardly at an angle a relative to and above axis 21.

Another basic element of the apparatus comprises a mop seen at 35 and having flaccid strands 36 shown in FIG. 1, as extending forwardly of the front side 25 of the carrier in direction 37. Second means is provided for attaching the mop to the carrier, whereby the strands 36 extend in generally parallel relation with surface 11, the lower strands freely engaging that surface, for mopping same when the carrier 13 is moved frontwardly and rearwardly in directions 40, as seen in FIG. 1, and simultaneously with bristle scrubbing engagement with the surface.

Accordingly, the downward component 41 of handle force 42 exerted on carrier 13 acts to push the bristles downwardly into and over the crevices, cracks and interstices 17 at the same time as the forward component 43 of handle force pushes or displaces the flaccid mop strands 36 forwardly, and subsequently the rearward component 43*a* of handle force pulls the strands 36 rearwardly over the interstices and cracks 17, to displace liquid into and from the crevices and cracks 17, carrying away or removing the bristle loosened soils and dirt. Fresh, aqueous liquid and/or cleaner is simultaneously mopped into the crevices or cracks to aid in loosening remaining soils and dirt, as the bristles are subsequently displaced forwardly again, with downward force component applicable at 41 to further or complete the soils and dirt loosening in the cracks and crevices filled with mopped liquid. The downwardly yieldable resilient spring aspect of the relatively stiff bristles assists in their penetration of the cracks and crevices under the influence of the downward force component 41.

The mop 35 has flaccid strand lateral dimension approximating the lateral dimension 44*a* of the brush carrier, and bristles, whereby the simultaneous mopping and scrubbing effect, as described, is attained throughout the approximately equal lateral extents of the carrier and mop.

Further, preferred attachment of the mop head 50 proximate the front side 25 of the carrier 13, above the level of the floor (see dimension 51 in FIG. 1) attains maximum proximity of the main extent of the mop to the floor 11, to enhance mopping and scrubbing effect, as described, while also facilitating direct, forward and rearward force transmission from the carrier to the mop head 50 and to the mop 35, for ease of required force transmission (push and pull) to the handle from the user's arm.

The mop head 50 consists of a tightly gathered bundle of mop strand portions, which may be clamped together, as at 50*a*. The tight bundle also provides a semi-rigid support and holder for attachment of the mop head to the front side 25 of the carrier 13, with the laterally elongated head 50 in parallel relation to the laterally elongated carrier front side or side wall 25. A mutually supporting relation of the head and carrier is thereby achieved.

Manually adjustable structure is provided for adjustably attaching the mop head to the carrier 13. In the preferred embodiment of FIGS. 1–3, a second carrier part 13*b* is provided to be movable relative to the above-described carrier 13 (or first carrier part); and second part 13*b* is adjustably movable longitudinally to clamp the mop head. In FIG. 1, the part 13*b* is adjustably movable leftwardly, i.e., forwardly, relative to carrier 13, to cause the V-shaped surfaces 13*c* and 13*d* to clamp and center the mop head at engagement location 13*c'* and 13*d'*.

The adjustable structure also includes a bail 65 carried by carrier 13 to adjustably swing about an axis 66, into mop head clamping position, i.e., the position seen in FIG. 1. The bail has pivotal attachment, as at 67, to side openings 67*a* in walls 27 and 28 of the carrier 13, whereby bail cross bar 65*a* can be swung upwardly, allowing the mop head to be fitted over the bar 65*a,* and subsequently swung downwardly to FIG. 1 position. Thereafter, the carrier part 13*b* in the form of a bar is displaced leftwardly to FIG. 1 position, to clamp the mop head between cross bar 65*a* and the V-shaped surfaces 13*c* and 13*d*. Three-point support of the mop head is thereby achieved, locating it against slippage up or down, or otherwise, from the position shown. Carrier part 13*b* acts as a clamp, for the mop head.

Rotation of an adjustable rotor 69 shifts the carrier part 13*b* to the left and to the right, as needed, the rotor surface 69*a* protruding above the top surfaces of 13*b* and of 13, to allow easy adjustment. The rotor may carry a shaft 70 that projects longitudinally into carrier 13, to have threaded engagement with a nut 71 attached to 13, whereby as the rotor is rotated, it moves longitudinally with 13*b*. The rotor may have suitable attachment to 13*b,* as at 72, allowing rotor rotation, and also travel with 13*b*.

FIGS. 3 and 4 show guide pins 80 and 81 carried by part 13*b,* and projecting longitudinally rearwardly for reception in guide bores 80*a* and 81*a* in carrier block 13, to guide longitudinal movement of 13*b* relative to 13. Upward projections 80*b* and 81*b* on the pins are received in slots 84 and 85 in the carrier block, and are engageable with slot terminal shoulders 84*a* and 85*a* to prevent removal of 13*b* from 13.

Figure 5:
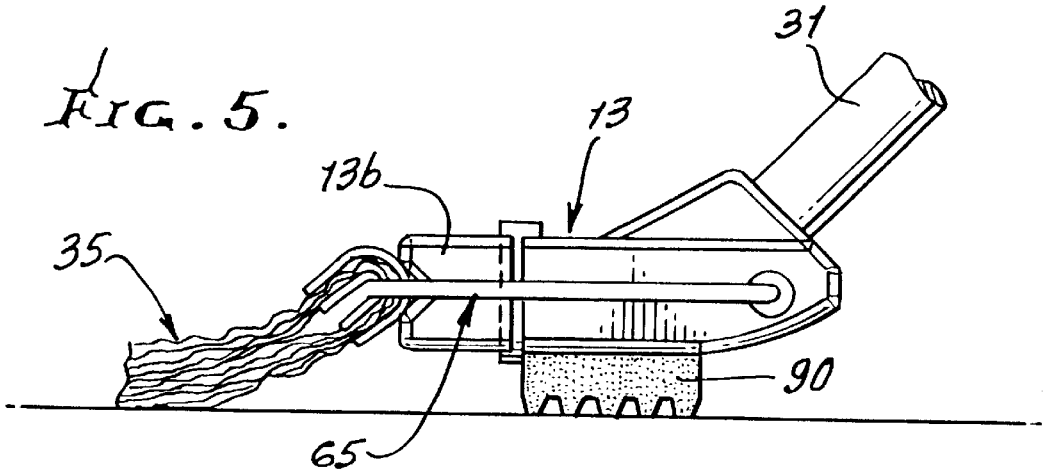
FIGS. 5–7 are elevations like FIG. 1 but showing modifications.

FIG. 5 is like FIG. 1 excepting that a scrubbing pad 90 is substituted for the bristles.

Figure 6:
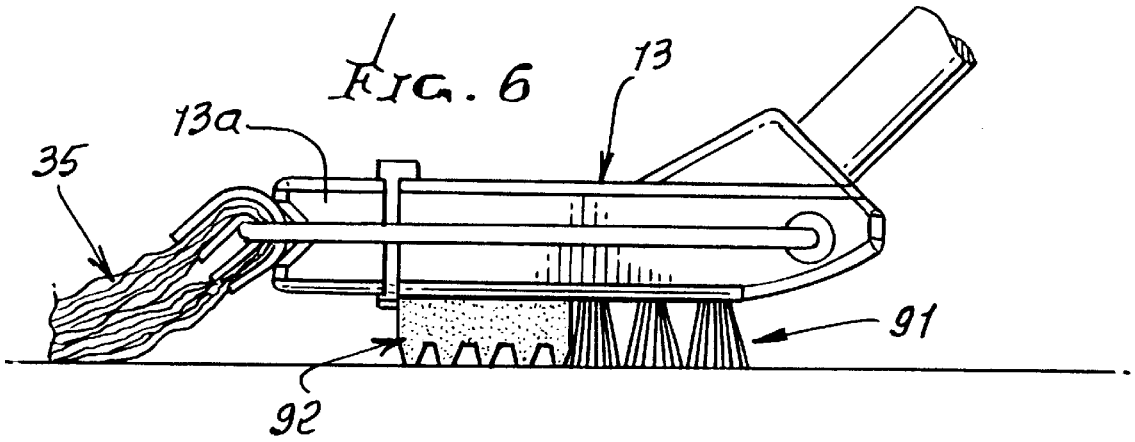

FIG. 6 shows both bristles 91 and a scrubbing pad 92, substituted for the bristles of FIG. 1.

Figure 7:
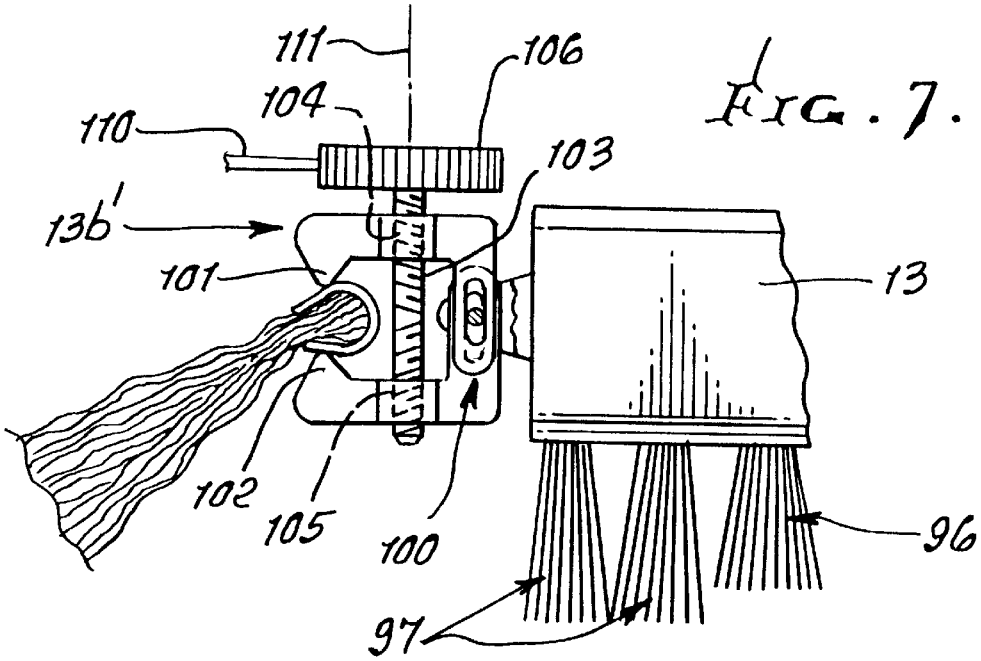

FIG. 7 shows bristles 96 in one lateral row of relatively shorter length; and bristles 97 in other lateral rows of relatively longer length. FIG. 7 also shows a modified carrier second part 13*b'* attached at 100 to carrier part 13. Carrier second part 13*b'* is C-shaped to form clamp jaws 101 and 102, for clamping the mop head. A threaded shaft 103 engages threading at 104 and 105 in the clamp to move the jaws toward or away from one another, as a rotor 105 is rotated in one direction or the other.

Threading 104 is in reverse sense relative to threading 105. A lever arm 110 may project from the shaft or from the rotor, to provide greater clamping force, as the lever is rotated about axis 111. An over-center detent may be provided.

Note that in FIGS. 1–7, attachment of the mop head to the carrier is provided at a second location 52 (see FIG. 4) forwardly spaced from the first means of attachment of the handle to the carrier block. This assures that the downward component of force 41 will be substantially completely transmitted to the scrubbing means, and not to the mop itself, for maximum scrubbing effect. Spacing 51 assures this. Note in this regard that the second location 52 attachment and the attachment at 30 define an upright and forward plane that bisects the carrier body or block. That plane bisects the scrubbing means, the mop head 50 and the mop 35 for optimum stability during use.

Figure 8:
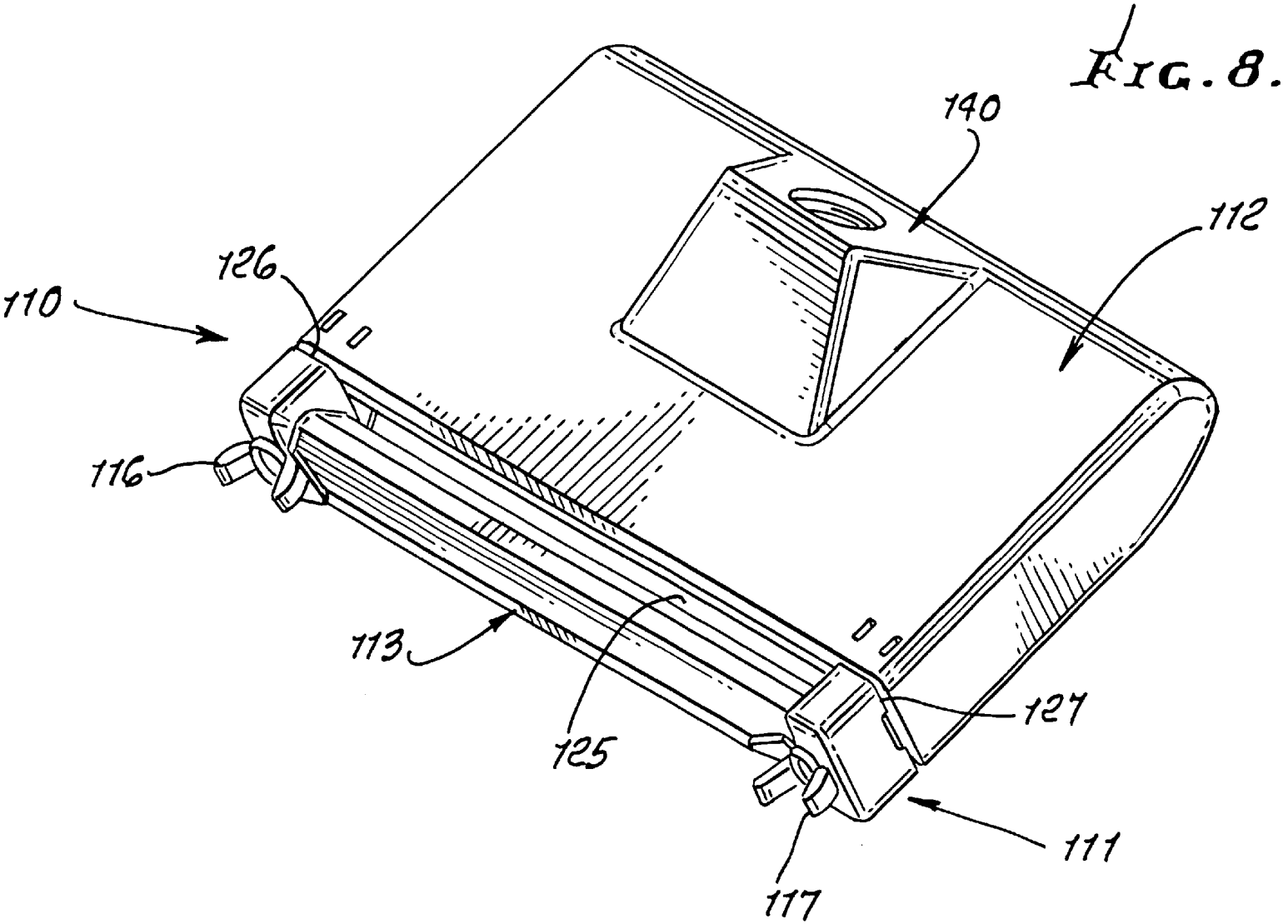
FIG. 8 is a view like FIG. 2 but showing a modification.
Figure 9:
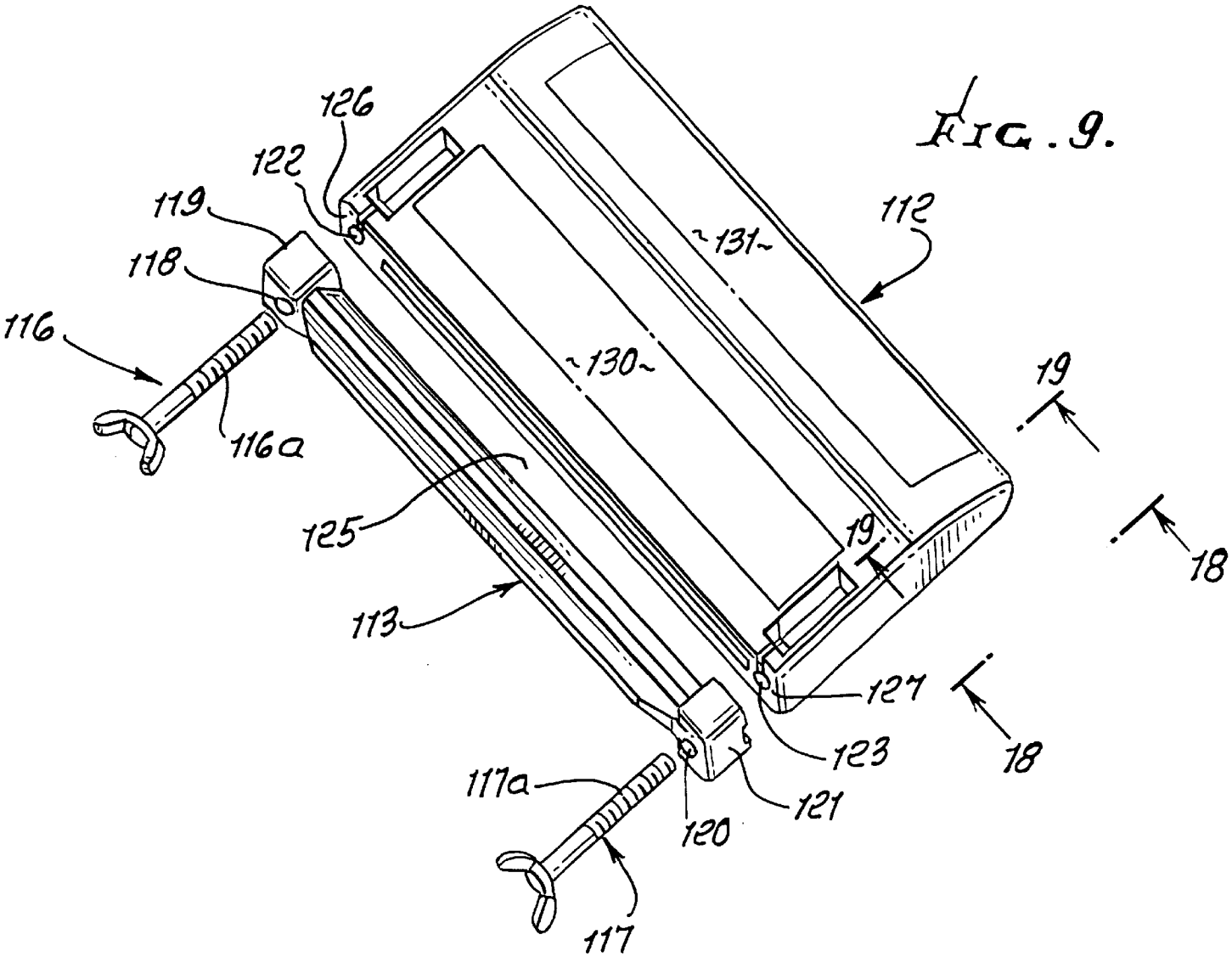
Figure 10:
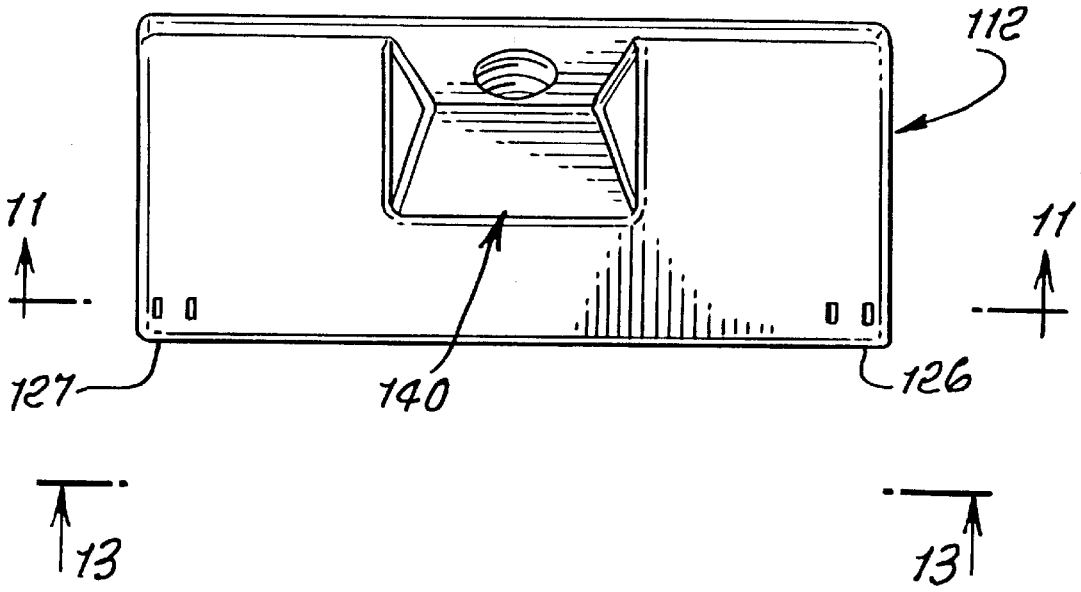
FIG. 10 is a plan view of a first of the parts seen in FIG. 8 and having a top protrusion.
Figure 11:
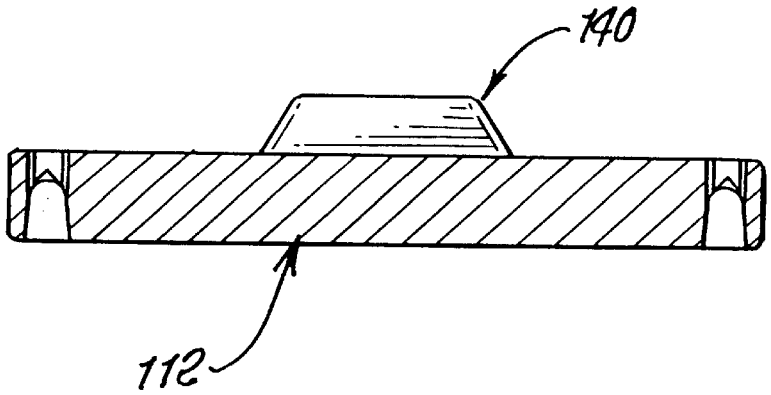
FIG. 11 is a section taken on lines 11—11 of FIG. 10.

In the embodiment shown in FIGS. 8–19, the carrier second part, which is relatively movable longitudinally, with respect to the carrier first part, has attachment to that first part at substantially laterally spaced locations, generally indicated at 110 and 111 in FIG. 8. The first part is generally indicated at 112, and the second part is generally indicated at 113. Part 112 corresponds to carrier 13; and the carrier second part 113 corresponds generally to carrier part 13*b* in FIG. 2, in that it is movable longitudinally relative to part 112. Part 113, in the form of a bar extending between locations 110 and 111, also incorporates the functions of the bar 65 seen in FIG. 2, in that it attaches the mop to the carrier structure.

Figure 9:
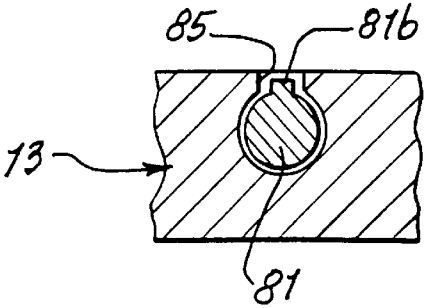
FIG. 9 is an exploded view, like FIG. 3, of the FIG. 8 modification.

Two fasteners, such as those indicated at 116 and 117, are provided at the laterally spaced locations, such fasteners being adjustable to allow relative longitudinal movement of the parts 112 and 113. For example, as seen in FIG. 9, fastener 116 has a shank 116*a* that extends through an opening 118 in a lug 119 on bar part 113; and likewise, fastener 117 has a shank 117*a* that extends through an opening 120 in a lug 121 on the other end of the bar part 113. There are corresponding openings at 122 and 123 in the carrier part 112, to receive the fastener shanks, which may be threaded for tightening purposes. Tightening of the two fasteners adjustably clamps the mop head in the laterally elongated space 125, between 112 and 113; and lugs 119 and 121 may seat against the front surface of the part 112 at locations 126 and 127 for positioning purposes. Loosening of the fasteners allows quick and easy removal of the mop.

Figure 12:
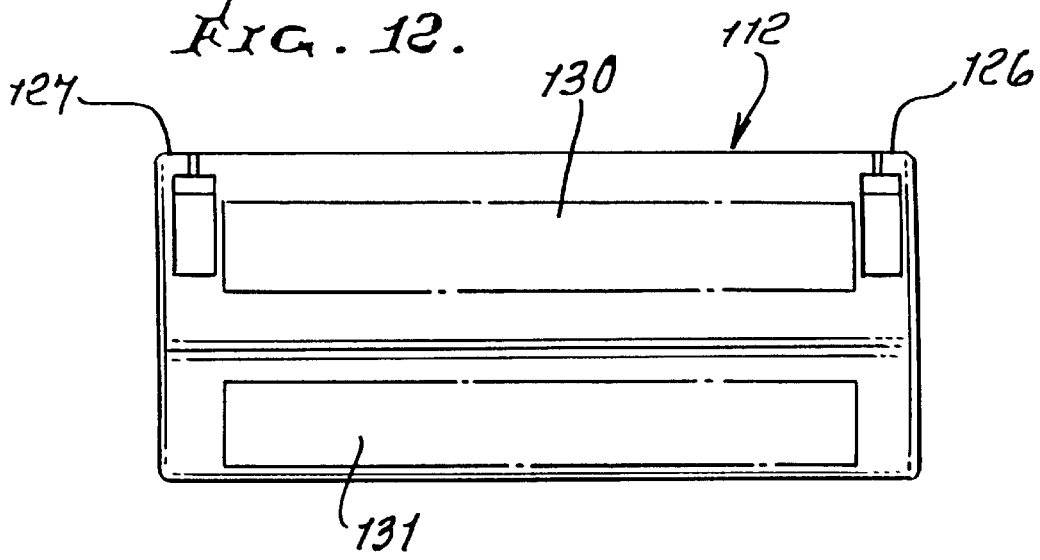
FIG. 12 is a bottom plan view of a FIG. 10 part.
Figure 13:
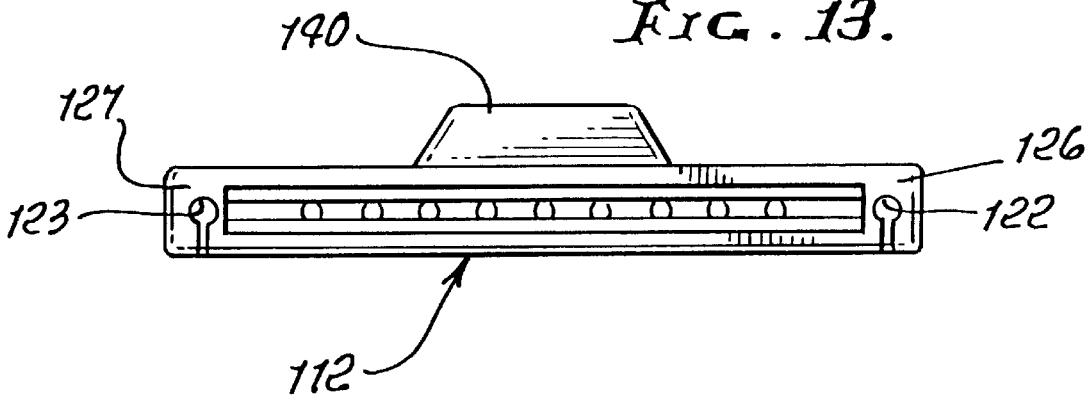
FIG. 13 is a front view taken on lines 13—13 of FIG. 10.
Figure 14:
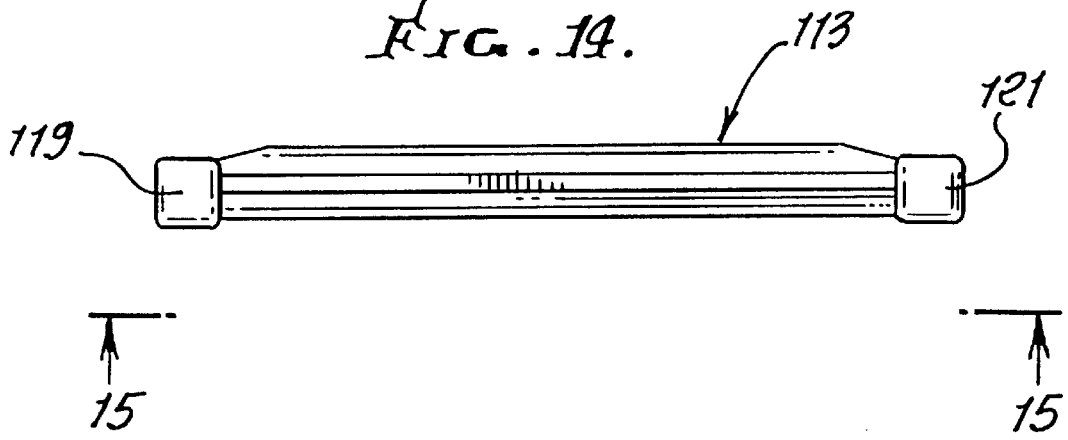
FIG. 14 is a top plan view of the other of the carrier parts seen in FIG. 9.
Figure 15:
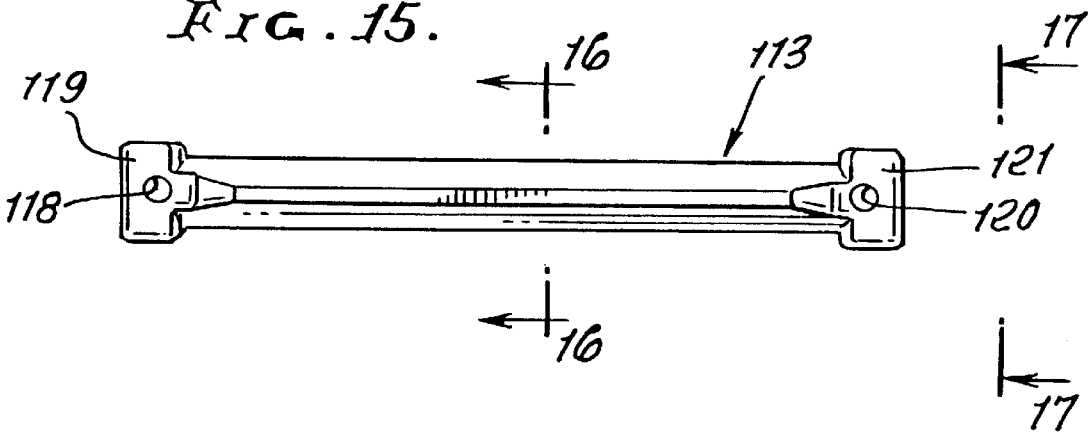
FIG. 15 is a front view taken on lines 15—15 of FIG. 14.
Figure 16:
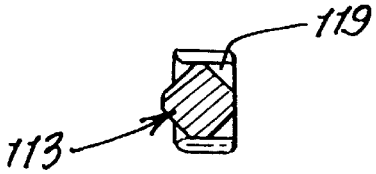
FIG. 16 is an end view taken on lines 16—16 of FIG. 15.
Figure 17:
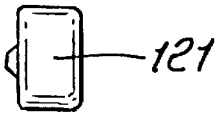
FIG. 17 is an end view taken on lines 17—17 of FIG. 15.
Figure 18:
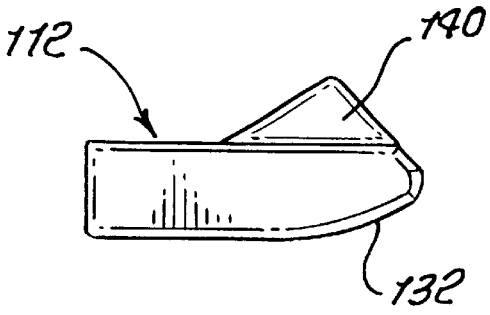
FIG. 18 is a fragmentary elevation taken on lines 18—18 of FIG. 9.
Figure 19:
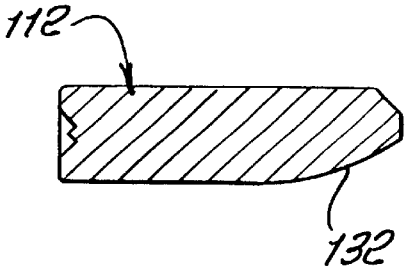
FIG. 19 is a section taken on lines 19—19 of FIG. 9.
Figure 20:
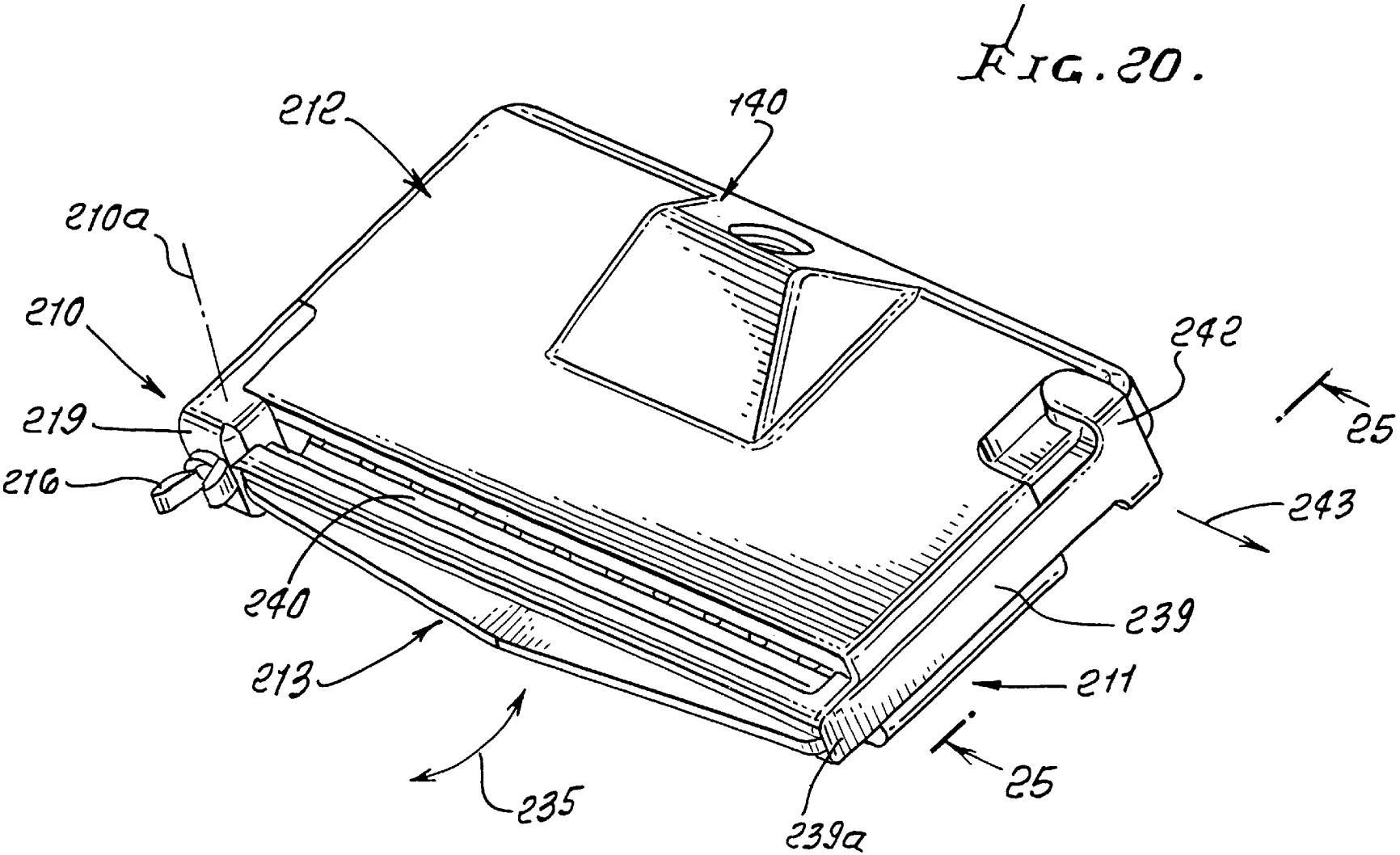
FIG. 20 is a view like FIG. 2 showing a further modification.
Figure 21:
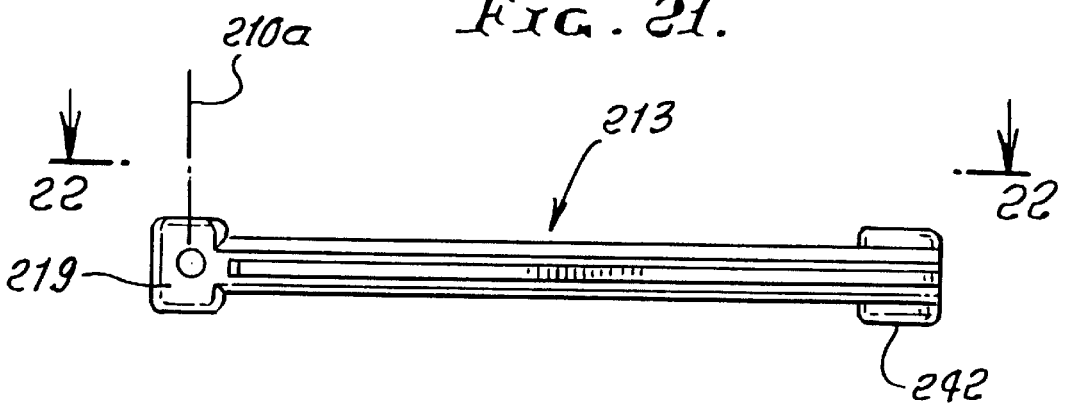
FIG. 21 is a front elevation showing a swingable second part of the apparatus seen in FIG. 20.
Figure 22:
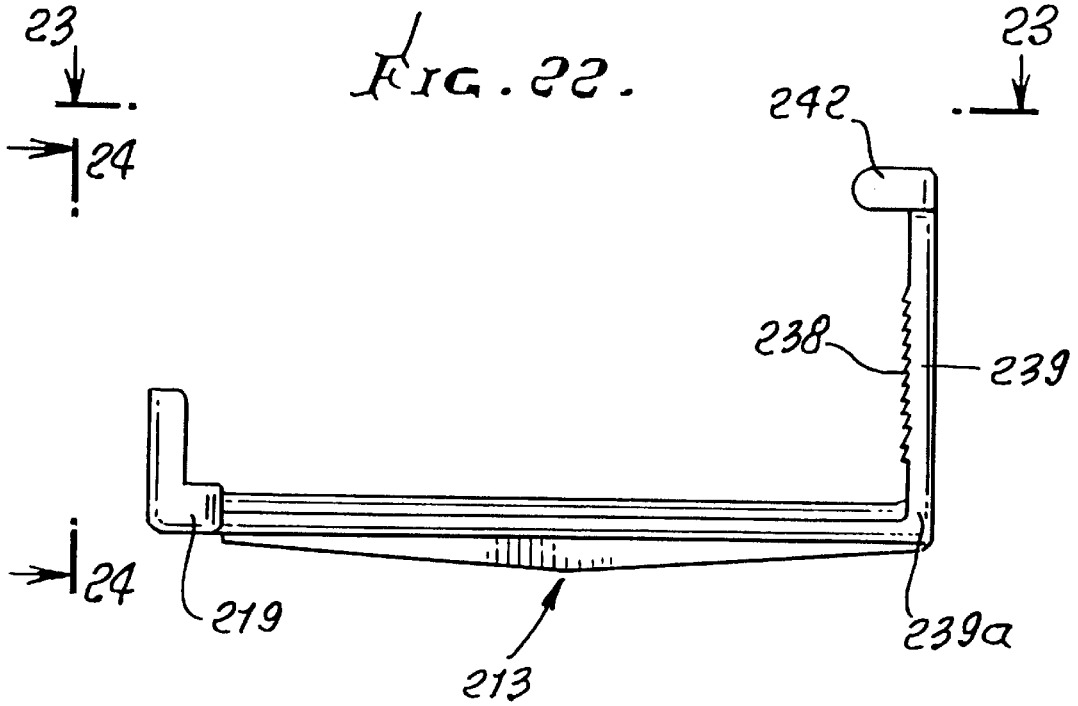
FIG. 22 is a plan view taken on lines 22—22 of FIG. 21.
Figure 23:
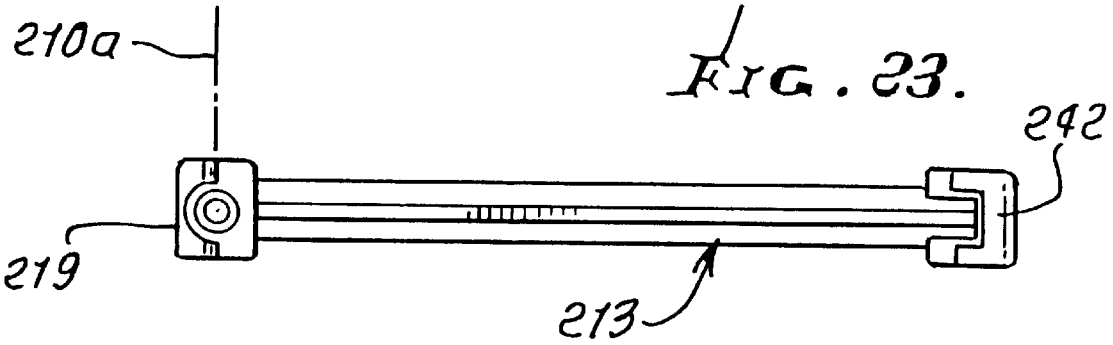
FIG. 23 is an elevation taken on lines 23—23 of FIG. 22.
Figure 24:
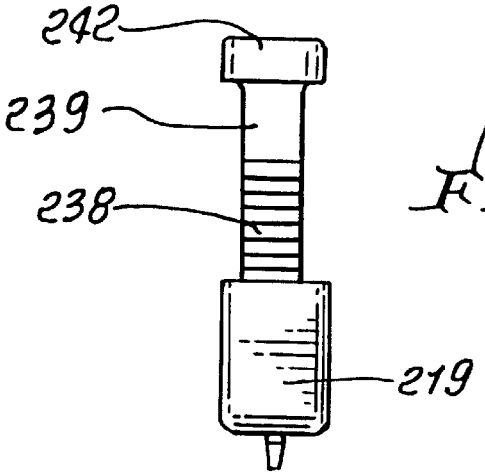
FIG. 24 is an end elevation taken on lines 24—24 of FIG. 22.

Referring to FIGS. 9 and 12 showing the bottom side of the carrier 112, bristles may be located at areas or zones 130 and 131 to extend downwardly for engagement with the floor. Note also in FIGS. 18 and 19 the coving of the underside of the carrier 112, at location 132. This allows upright positioning of the carrier, during use, against a wall, so that the bristles at 131 can extend to the intersection of the floor and the wall for scrubbing at that location, very close to the wall. Similar coving is shown at 24*a* in FIG. 2. Upright protrusion 140 on 112 corresponds to 13*a* in FIG. 2.

Reference is now made to the modification in FIGS. 20–26. As shown, the first carrier part 212 is generally like that seen at 13 and also at 112, and carries bristles and/or a scrubbing pad at its underside.

The second carrier part 213 is attached to the first part at substantially laterally spaced locations 210 and 211. Laterally elongated, bar-shaped part 213 has pivoted attachment at one of such locations, as for example location 210, whereby the second part 213 is swingable frontwardly toward and away from the first part, for example as indicated by the arrows 235 in FIG. 20. A vertical pivot axis is provided at 210*a,* seen in FIG. 20, and also in FIGS. 21 and 23. A lug 219 on the bar part 213 has rotary attachment to structure on the carrier part 212 to allow such pivoting. A fastener 216 may also be provided at that location, to adjustably connect the lug to the carrier part 212.

The first and second parts 212 and 213 are shown to have longitudinally adjustable attachment to one another at the second of such locations, generally indicated at 211. Such longitudinally adjustable attachment is shown to be provided in this form of the invention, as by a ratchet connection between such parts.

Figure 25:
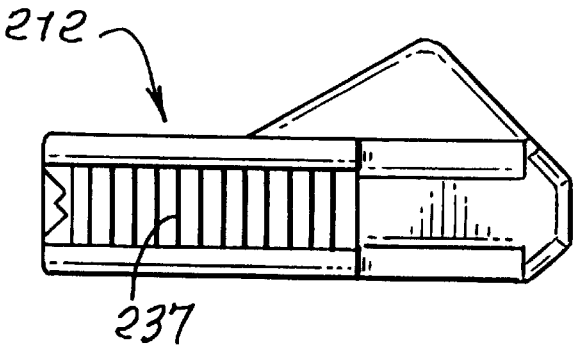
FIG. 25 is an enlarged fragmentary end view taken on lines 25—25 of FIG. 20.
Figure 26:
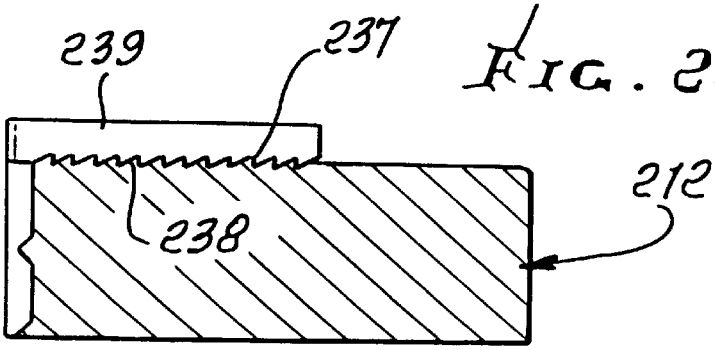
FIG. 26 is a section showing ratcheted interconnection of the first and second parts in FIG. 20 condition.

The ratchet teeth on the carrier part 212 are shown at 237 in FIG. 25, whereby they are at the laterally located end wall of the carrier. The ratchet teeth 238, associated with the bar part 213, are provided on an arm 239, which extends longitudinally, and has one end 239*a* integral with the right end of the bar 213. See also FIGS. 22 and 24. When the arm 213 is pivoted toward the carrier part 212, the ratchet teeth 237 and 238 come into adjustable interconnection, as seen in FIG. 26, to hold the part 213 adjustably frontwardly attached to the part 212, with a space 240 therebetween that receives the mop head, in the manner described in FIGS. 8 and 9.

In this regard, arm 239 may be adjustably positioned, longitudinally, to engage the ratchet teeth at relative positions to firmly retain the mop head in position. To release this interconnection, a lug 242 at the opposite end of the arm may be pulled in direction 243 in FIG. 20, disengaging the ratchet teeth and allowing part 213 to be swung away from part 212. The mop, including its head, may then be withdrawn from positioning between parts 212 and 213. The ratchet connection enables adjustable tightening or loosening of the mop head retained to the carrier structure.

Figure 27:
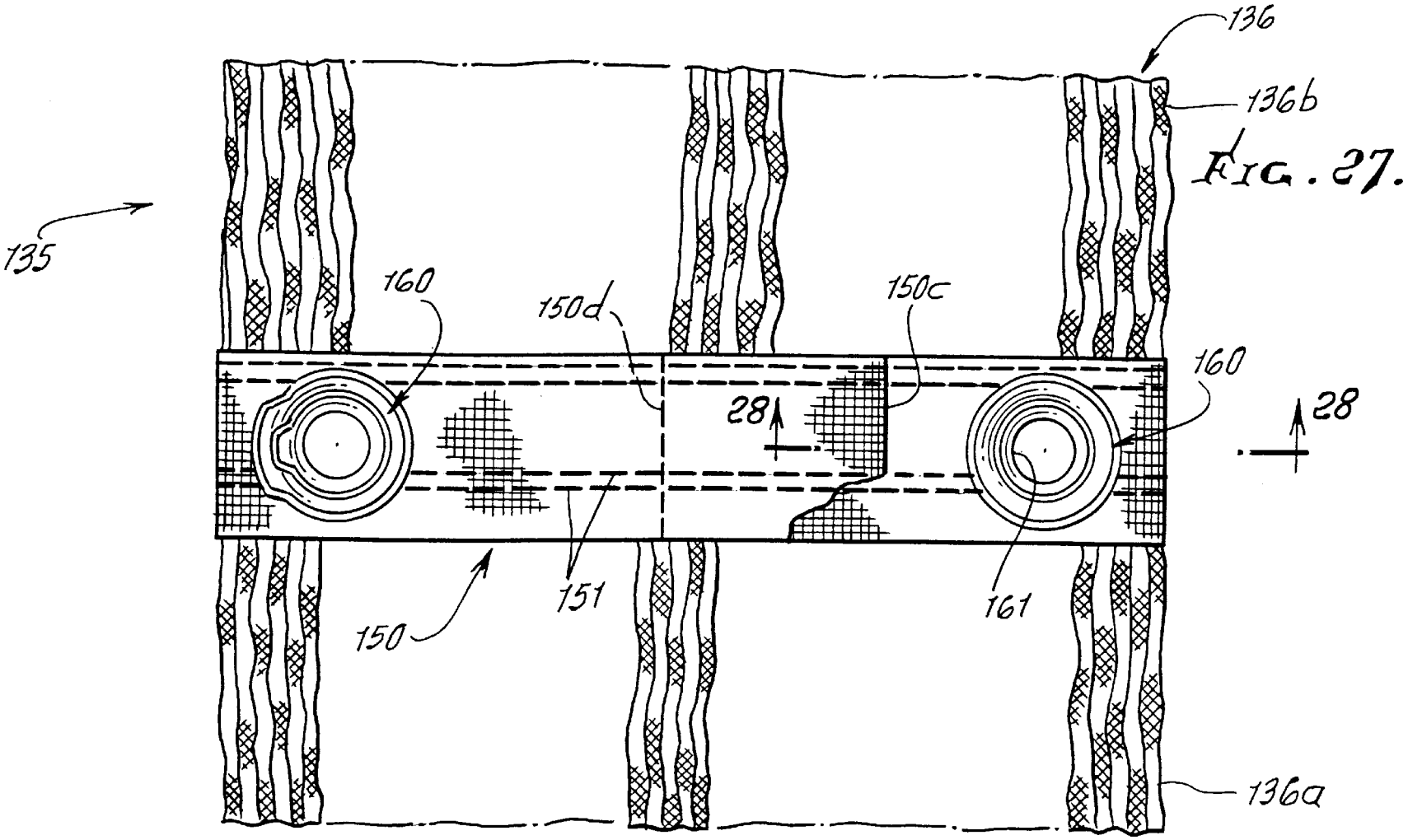
FIG. 27 is a plan view of an improved mop to be used with carrier apparatus generally of the type described in FIGS. 1–26.
Figure 28:
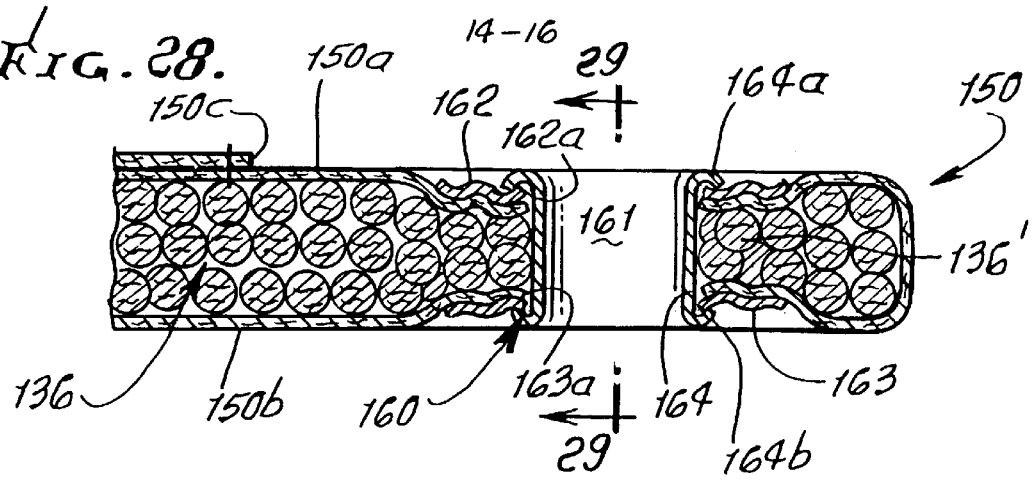
FIG. 28 is a section taken on lines 28—28 of FIG. 27.
Figure 29:
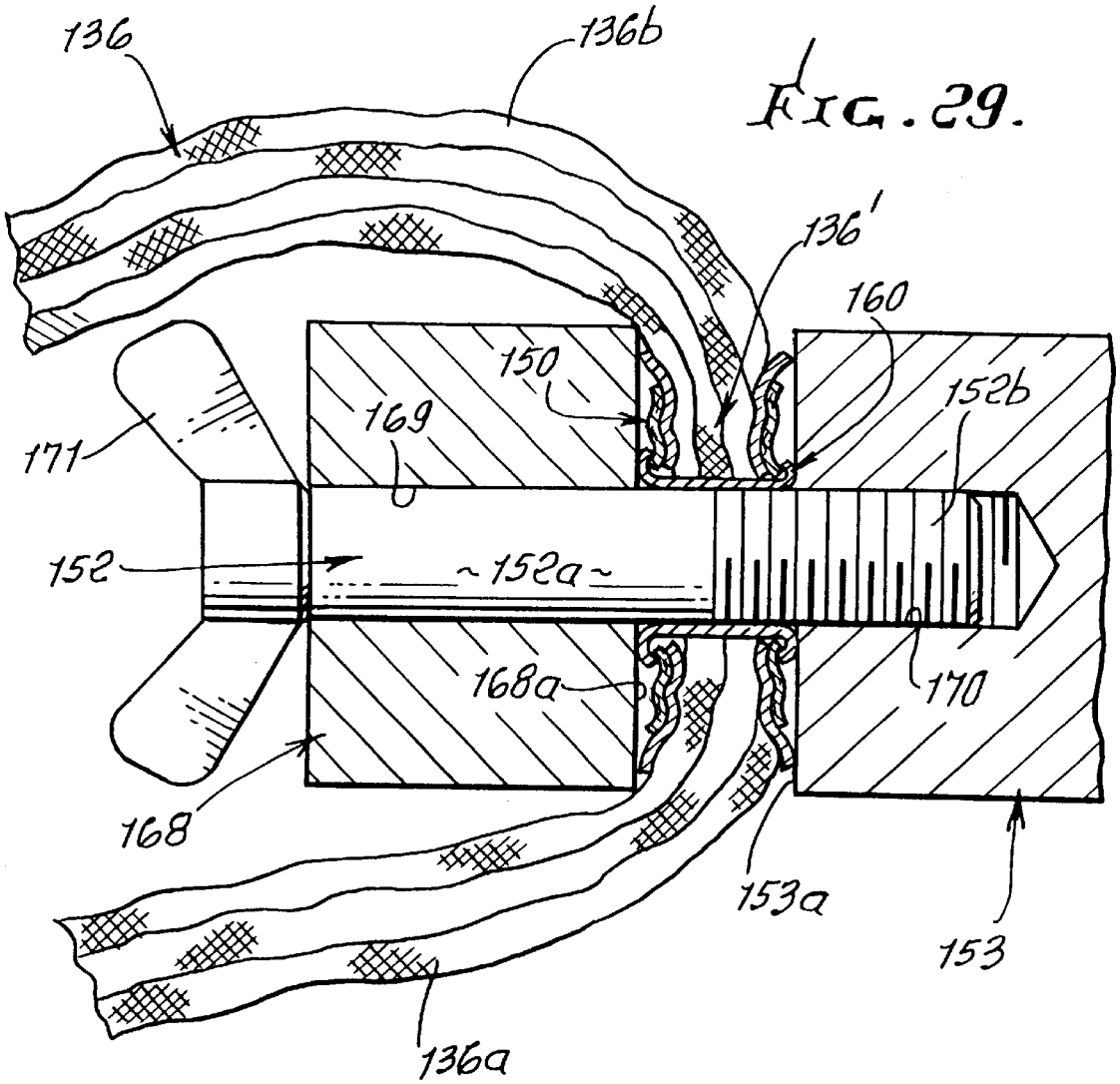
FIG. 29 is a section taken on lines 29—29 of FIG. 28 and showing mop attachment to a carrier block, via fasteners and grommets.

Referring to FIGS. 27–29, the modified and herein preferred mop 135 has flaccid strands 136 extending at 136*a* at one longitudinal side of the head band 150, and at 136*b* at the opposite longitudinal side of the head band. The head band is shown extending laterally in FIG. 27; and it may consist of upper and lower fabric layers 150*a* and 150*b* that bind to the mop strands 136 passing between those layers. Stitching to bind the head band and strands together is seen at 151, as in FIG. 27. Fabric layer end portions are seen at 150*c* and 150*d.*

Two fasteners 152 connect the mop head band to the block-shaped carrier 153 corresponding to carrier 13, as for example is shown in FIG. 29. Such attachment is typically facilitated by the provision of two grommets 160, which form openings 161 to closely pass the fasteners, those openings extending through the head band. The grommets serve to laterally stabilize the connection of the mop head band to the carrier block, and to allow ready connection to the mop to the carrier block, and disconnection, facilitating quick replacement of the mop. Also, the grommets spread transfer forces from the mop to the carrier block and vice versa, throughout the grommet area, which substantially exceeds the fastener cross-sectional area.

FIG. 29 shows grommet gripping of the mop strands 136' between grommet corrugated, generally parallel, discs 162 and 163. Those discs have inner edges 162*a* and 163*a* retained by a grommet sleeve 164 having radially outwardly turned annular edge portions 164*a* and 164*b,* which act to retain the discs in mop strand clamping relation. Also, as seen in FIG. 29, the sleeve edge portions are clamped between the wall 153*a* of block 153, and wall 168*a* of clamp bar 168. The latter provides two openings 169, which pass the shanks 152*a* of two fasteners 152. Fastener thread 152*b* engage thread 170 in the block 153. The fastener typically has a wing nut-type adjustment at 171.

Figure 32:
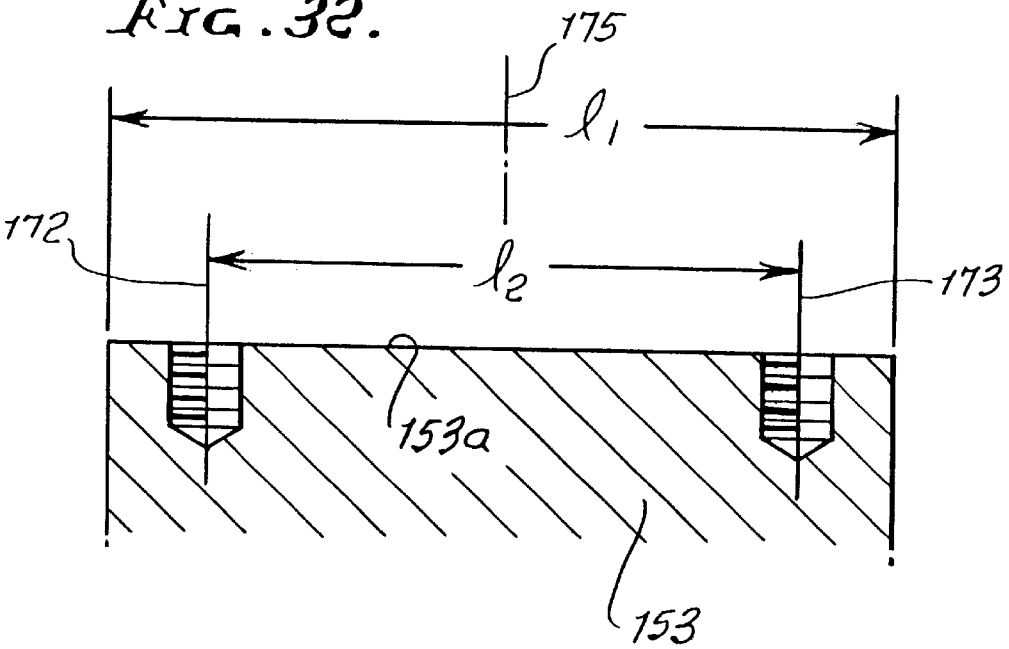
FIG. 32 is a schematic showing of spacings related to head band and grommet attachment to a carrier block.

FIG. 32 shows the positioning of the grommet parallel axes 172 and 173 at a lateral separation $l_2$. The head band has an overall lateral length about equal to the width $l_1$ of the block front wall 153*a*. The lateral length $l_2$ is substantially less than $l_1$, but is substantially greater than ½ $l_1$, providing lateral stability of the mop connection to the carrier block.

A plane 175 extending longitudinally (i.e., normal to the plane of FIG. 32) and passing through the handle (and preferably the handle axis) also bisects the lateral spacing between the grommets and also the lateral spacing $l_2$ between the grommet axes.

The part 153*a* of the carrier and part 168*a* of the arm 168 are adjustably relatively movable longitudinally, to clamp and unclamp the mop head band, as described. Part 168 may comprise an arm carried by block 153 to adjustably swing into mop head band clamping position, as in the manner of the FIG. 20 embodiment.

Figure 30:
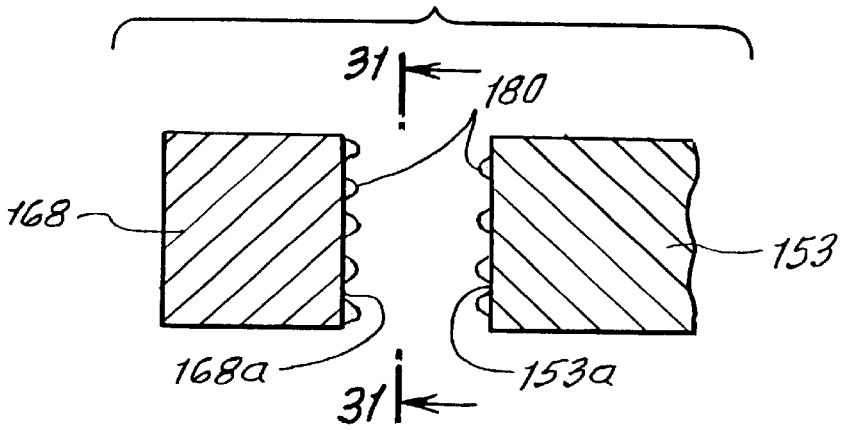
FIG. 30 is a section taken through mop head band gripping means having teeth.
Figure 31:
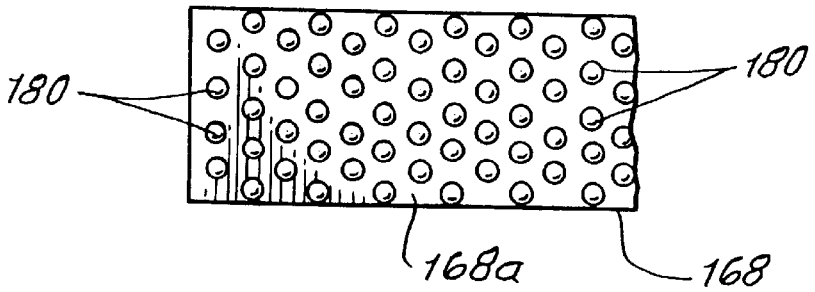
FIG. 31 is a view taken on lines 31—31 of FIG. 13.

FIGS. 30 and 31 show provision of conical teeth 180 attached or molded to 153 and 168 to protrude from faces or walls 153*a* and 168*a* toward the head band, to penetrate the head band. Such teeth are typically laterally spaced from the grommets.

The structure of the apparatus, other than of the mop and its grommets, may take any of the forms of FIGS. 1–26.

Figure 33:
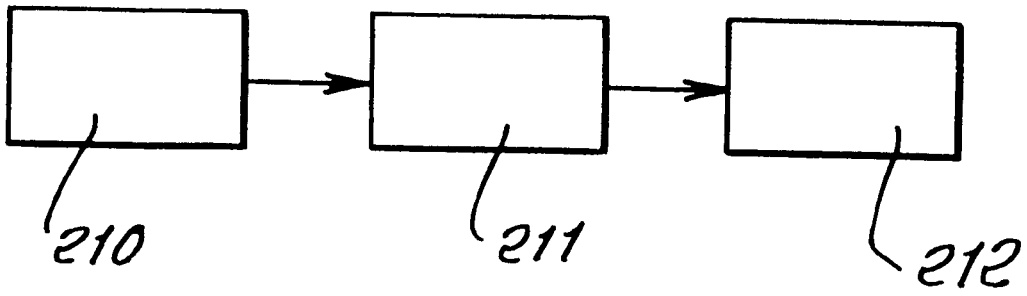
FIG. 33 is a flow diagram showing a surface treatment process employing multiple treatment materials, and as also related to mopping.

Referring to FIG. 33, it shows a three-step surface treatment process, applicable for example to room surfaces, such as floors and walls. The first step indicated at 210 is the application of a flowable spray-on pesticide to first surfaces, at room corners and crevices, as may be accomplished by workers in the evening.

The second step, indicated at 211, is the application of a traction restorative or restoratives to adjacent or contiguous floor surfaces, as for example walkways in the same room or room where the first surfaces are located as by the same workers, and generally at the same time as the pesticide application. Such closely related applications enhance efficiency and enable visible surface area application differentiation, as is useful in relation to subsequent mopping. The restorative typically chemically reacts with silica or silica-containing materials in the floor.

These steps, 210 and 211, may then be followed by later application of a mop to the treated surface or surfaces, the mop being aqueously wetted, for example. See step 212. The restorative materials are typically in aqueous carrier solution, and therefore excess materials may be removed by the absorbing characteristics of the mop, passed back and forth over the surface or surfaces. The mop strands are then squeezed to remove the picked up materials.

The mop of the present invention is particularly useful in this process, due to its capability for quick attachment to, and removal from, the carrier block, as via the described grommet openings and fasteners. Thus, one mop attached to the carrier block may be employed for spreading and/or scrubbing the pesticide sprayed on the surface; it may be removed and a second mop attached to the block for spreading and/or scrubbing the restorative; and after removal of the second mop, a third mop may be attached to the carrier block, for use in picking up the excess flowable materials from the surface.

Representative pesticides include the following, which are known:

botanicals pyrethroids inorganics organophosphates, carbamates, and other neurotransmitter disrupters bait toxicants fumigants insect growth regulators others Examples of botanicals include pyrethrum, rotenone, ryania, and di-limonene and other related terpenes.

Examples of inorganics include boric acid, sodium fluoride, silica aerogel (a type of fumed silica), and diatomaceous earth.

Examples of carbamates include carbaryl (Sevin™), propoxur (Baygon™), and bendiocarb (Fica™).

Examples of bait toxicants include inorganic insecticide boric acid (Drax™, MRF 2000™, NiBan™ FG, and others), and the organic materials hydramethylnon (Maxforce™, Subterfuge™, and Siege™), sulfluramid (ProControl™ and FluorGuard™), and abamectin (Avert™).

Examples of fumigants include napthalene and paradichlorobenzene, aluminum phosphide (Phostoxim™), and magnesium phosphide (Mag Tox™).

Representative surface restoratives include fluoride-containing compounds selected from the group essentially consisting of hydrofluoric acid, ammonium, bifloride, or other silica reactive or organic acid family groupings. Fluoride-containing compounds may be formulated with institutional and industrial grade fluoride.

Mops, other than those described herein, may be used in the three-step process of FIG. 33; however, mops, as described herein, are preferred, due to their unusual advantages and use characteristics.

We claim:

1. A method of cleaning a surface comprising:

a) providing a carrier block, to be pushed and pulled by an elongated handle;

b) providing a mop having a laterally extending head band, and mopping strands extending longitudinally from said head band;

c) providing at least two grommets attached to the head band to define through openings for passing fasteners;

d) attaching the mop to the carrier block by passing said fasteners through said grommet openings and attaching the fasteners mop to the carrier block; and e) moving the mop in a back and forth motion while applying and removing a flowable treatment to said surface.

2. The method of claim 1 further including applying treatment material to said surface, and removing said material by passing said mop over and in contact with said material on said surface.

3. The method of claim 1 wherein said treatment material is flowable and including at least one of the materials selected from the group consisting of a pesticide and a surface restorative.

4. A method of treating a surface or surfaces comprising the following steps:

a) applying a flowable pesticide material to said surface or surfaces;

b) applying a flowable surface restoration material to said surface or surfaces, in closely timed relation to said step a);

c) and removing excess material from said surface or surfaces by providing and passing at least one mop over and in contact with said flowable pesticide or surface restorative material on said surface or surfaces.

5. The method of claim 4 further including preliminarily providing a carrier block, and said mop having grommets defining openings in a mop head band, and attaching said head band to said carrier block by providing fasteners to extend through said grommet openings and attach to said block.

6. The method of claim 4 further including providing and employing different mops for use in separate respective steps, and sequentially attaching the different mops to a carrier block, to be pushed and pulled via a handle attached to said block.

7. A method of treating a surface comprising the steps of:

a) applying a flowable pesticide material to the surface, said surface including corners and crevices of a room; and b) applying a flowable surface restorative or traction material to the surface, said surface including a walkway in said room; wherein the applications in steps a) and b) being applied to contiguous surfaces in said room, and said applications effected during a single work period.

* * * * *

UNITED STATES PATENT AND TRADEMARK OFFICE

CERTIFICATE OF CORRECTION

PATENT NO. : 6,251,194 B1
DATED : June 26, 2001
INVENTOR(S) : Todd A. Williams et al.

It is certified that error appears in the above-identified patent and that said Letters Patent is hereby corrected as shown below:

Column 1,
Line 53, replace "length 11," with -- length $l_1$, --.

Column 4,
Line 31, replace "a" with -- $\alpha$ --.

Column 9,
Line 17, replace "Fica" with -- Ficam --.

Signed and Sealed this

Seventh Day of May, 2002

*Attest:*

*Attesting Officer*

JAMES E. ROGAN
*Director of the United States Patent and Trademark Office*